United States Patent [19]

Pfoh et al.

[11] Patent Number: 4,743,362

[45] Date of Patent: May 10, 1988

[54] PROCESS AND DEVICE FOR CONTROLLING THE ELECTROSTATIC SEPARATION OF CRUDE POTASH SALTS IN ELECTROSTATIC FREE FALL SEPARATORS

[75] Inventors: Oskar Pfoh, Ahnatal; Christian Radick, Vellmar; Helmut Thenert, Heringen, all of Fed. Rep. of Germany

[73] Assignee: Kali und Salz Aktiengesellschaft, Kassel, Fed. Rep. of Germany

[21] Appl. No.: 776,956

[22] Filed: Sep. 17, 1985

[30] Foreign Application Priority Data

Sep. 18, 1984 [DE] Fed. Rep. of Germany ..... 3434190

[51] Int. Cl.[4] ..... B03C 7/12

[52] U.S. Cl. ..... 209/127.4; 73/863.57; 209/127.1; 364/502

[58] Field of Search ..... 209/127.1, 127.4, 129, 209/577, 589, 552; 73/863.52, 863.55, 863.57, 863.41, 863.61, 861.01-861.03; 364/502 X, 167, 174

[56] References Cited

U.S. PATENT DOCUMENTS

| | | | |
|---|---|---|---|
| 3,339,700 | 9/1967 | Wells | 73/863.57 |
| 3,493,109 | 2/1970 | Carta et al. | 209/127.1 |
| 4,026,154 | 5/1977 | Pfeiffer et al. | 73/863.41 |
| 4,236,640 | 12/1980 | Knight | 209/577 |

FOREIGN PATENT DOCUMENTS

| | | |
|---|---|---|
| 0064810 | 11/1982 | European Pat. Off. . |
| 1283772 | 7/1969 | Fed. Rep. of Germany . |
| 1792120 | 11/1972 | Fed. Rep. of Germany . |
| 1953534 | 7/1973 | Fed. Rep. of Germany . |
| 3118756 | 12/1982 | Fed. Rep. of Germany . |
| 3334665 | 10/1984 | Fed. Rep. of Germany . |
| 2331786 | 6/1977 | France . |
| 985796 | 3/1965 | United Kingdom . |
| 0583385 | 12/1977 | U.S.S.R. . |
| 0776642 | 11/1980 | U.S.S.R. . |
| 0780887 | 11/1980 | U.S.S.R. . |

OTHER PUBLICATIONS

S. T. Talresa et al., "Radiometric Determination of Potassium in Marine Chemicals and Seawater Concentrates", *Salt Research & Industry,* vol. 6, No. 2, Apr. 1969.

"Chemical Abstracts" published 1968 C.A. 69(1968), 32740g, C.A. 68(1968), 71365n.

"Ullmann's Encyklopaedie der technischen Chemie", 4th Edition, vol. 13, (1977), pp. 477 to 479.

*Primary Examiner*—Robert B. Reeves
*Assistant Examiner*—Donald T. Hajec
*Attorney, Agent, or Firm*—Michael J. Striker

[57] ABSTRACT

A process for controlling the electrostatic separation of crushed chemically conditioned and triboelectrically charged potash salts in a free fall wherein the setting angles of deviating blades for the separated material are controlled by means of a process computer in dependency on the $K_2O$-content of the residue which accumulates in the proximity of the negative, separating electrode. The mutual position of the blades determines the $K_2O$ and NaCl discharge and the amount of the obtained middling material.

7 Claims, 3 Drawing Sheets

PROCESS AND DEVICE FOR CONTROLLING THE ELECTROSTATIC SEPARATION OF CRUDE POTASH SALTS IN ELECTROSTATIC FREE FALL SEPARATORS

BACKGROUND OF THE INVENTION

As is known, crude potash salts can be separated into their main components by means of electrostatic separation. The principle of such separating processes is described, for example, in "Ullmann's Eancyklopaedie der technischen Chemie", 4. Auflage, Bd. 13 (1977), pages 477 to 479. In accordance therewith the crushed crude potash salt after chemical conditioning under heat is triboelectrically charged and is subsequently fed in a free fall through the electrical field of a so-called electrostatic free fall separator, which is mostly designed as a free fall tube separator. The movement of the particles in the electrical field of the separator is determined by the horizontally acting attraction force and the vertically directed gravitational force. This results in more or less curved course of fall of the individual particles of the components of the crude potash salt, which have a tendency to move toward the oppositely charged electrode. In order to prevent at the lower end of the electric field a remixing of the particles of the components of the crude potash salts which were separated in the aforementioned manner, there are arranged pivotable flow splitting blades made from electrically insulating material. The blades include with the vertical an acute angle opening toward the electrical field. Between these blades a middling material is collected whose particles have experienced only a small or no deflection in the electrical field. By the position of these flow splitting blades the amount and composition of the valuable substance concentrate and of the middling material can be influenced in the same way as the amount and composition of the separated residue.

The result of the electrostatic separation of the crude potash salts can be influenced and optimized by the adjustment of the incline of the separating blades. For this purpose, the contents of predetermined components in the valuable substance concentrate and in the residue were determined to serve as guiding magnitudes and thereafter the incline of the separating blades was adjusted manually in order to obtain an optimum separating result, namely a high enrichment in the valuable substance concentrate, and to receive a residue which is substantially free of valuable substances. This prior art manual adjustment of the incline of the separating blades is time consuming and substantially depends from the experience of the operating personnel and is subjected to numerous possibilities of error.

SUMMARY OF THE INVENTION

It is therefore an object of the invention to find possibilities for controlling the electrostatic separation of crude potash salts in a free fall separator which in particular avoids the manual adjustment of the incline of separating blades and thereby the resulting errors.

A process for controlling the electrostatic separation of crushed, chemically conditioned and triboelectrically charged crude potash salts in an electrostatic free fall separator had been found wherein an upright positive electrode is arranged opposite an upright negative electrode to generate an electrostatic field therebetween and the separating blades are arranged beneath the electrodes and their incline relative to the vertical is controlled automatically by means of a process computer in dependency on the $K_2O$-content in the residue which accumulates in the proximity of the negative electrode, on the discharge or yield of the $K_2O$ and NaCl and on the amount of the obtained middling material.

In the following the invention is explained by way of example of the electrostatic separation of a crude potash salt, which consists mostly of sylvin, rock salt and kieserite and may contain secondary constituents like langbeinite, polyhalite, anhydrite and the like. This crude potash salt is crushed to a grain size averaging $<1.0$–$1.5$ mm, so as to mechanically destroy intergrowth in the crude potash salt.

For a substantial separation of the rock salt from the crude potash salt, chemical conditioning agents are at first admixed which cause that during the subsequent electric contact charging of the crude potash salt, negative electrical charges transit from the rock salt to sylvin and kieserit. After the chemical conditioning, the crude potash salt under defined relative moisture and defined temperature is triboelectrically charged and thereafter is fed to the electrostatic free fall separator. Such mode of operations are known, for example, from the DE-PS No. 12 83 772, DE-PS No. 17 92 120 and DE-PS No. 19 53 534. A valuable substance concentrate consisting in its bulk of potassium chloride and kieserite, is isolated in the electrostatic free fall separator from the conditioned and triboelectrically charged crude potash salt. The valuable substance concentrate accumulates in the proximity of the base of the positive electrode of the free fall separator and is fed to a concentrate discharge chute by means of a separating blade. A residue consisting in its bulk of rock salt accumulates at the base of the negative electrode and is fed to a residue discharge chute by means of another separating blade. As mentioned before the middling material is collected between the two separating blades and after being crushed if need be, is admixed to the crude potash salt to be charged, and is fed therewith again into the electrostatic free fall separator. The following quantitative balance results for this separation:

$$M_A = M_R + M_{WK}, \quad \text{(I)}$$

wherein $M_A$ = amount of the freshly fed crude potash salt, $M_R$ = amount of the separated residue and $M_{WK}$ = amount of the valuable substance concentrate whereby the amounts are determined in quantity units per a time unit, for example in tons per hour, by means of devices for quantity measurement such as conveyor-type weighers. The electrostatic separation of crude potash salts should generate a concentration, wherein a possibly large constituent of the valuable substances, namely of potassium chloride and kieserit, and only a low constituent of rock salt, are present. On the other hand, the amount of middling material, which is practically fed in a closed cycle, must be maintained in a reasonable ratio with respect to the amount of the crude potash salt to be charged, in order to perform the separating process in a suitable manner technically as well as economically, even if the amount of the recirculated material does not play a direct role in the aforementioned quantity balance of the separation process. The resulting separating effect $\pi K_2O$ can be calculated with reference to the discharge of the $K_2O$ with the valuable substance concentrate, from the amount $M_{WK}$ of the concentrate and the $K_2O$-content $X_{WK}$ of the concentrate and from the amount of the charged crude potash salt $M_A$ and its $K_2O$-content as follows:

$$K_2O = \frac{M_{WK} \cdot X_{WK}}{M_A \cdot X_A} \cdot 100\ [\%] \quad \text{(II)}$$

and with reference to the discharge or yield $\pi$NaCl of the rock salt from the amount $M_R$ of the separated residue and the NaCl-content $Y_R$ of the residue in relation to the amount of the charged crude potash salt $M_A$ and its rock salt content $Y_A$:

$$rNaCl = \frac{M_R \cdot Y_R}{M_A \cdot Y_A} \cdot 100\ [\%] \quad \text{(III)}$$

The requisite content $X_A$ of $K_2O$ in the charged crude potash salt can be determined by calculation in accordance with the following equation $$X_A = \frac{M_R \cdot X_R + X_{WK}}{M_A}\ [\%] \quad \text{(IV)}$$

The values $M_R$, $X_R$, $X_{WK}$, and $M_A$ can be measured, while the amount of the valuable substance concentrate $M_{WK}$ can be calculated from the formula (I).

The values of rock salt content $Y_A$ of the charge goods and of rock-salt content $Y_R$ of the residue which are required for the formula (III) may be calculated in accordance with the following approximation formulas:

$$Y_A = -1.03\ Z_2 + 92.06\ [\text{weight } \%] \quad \text{(V)},$$

wherein $$Z_2 = \frac{X_A + M_A}{0.632}\ [\text{weight } \%], \quad \text{(VI)}$$

and $X_A$=$K_2O$-content of the charged goods in %, $W_A$=kieserit content of the charge goods in %, $$Y_R = 1.35.Z_1 + 98.8 \quad \text{(VII)}$$

wherein $$Z_1 = \frac{X_R + W_R}{0.632}\ [\text{weight } \%] \quad \text{(VIII)}$$

and $X_R$=$K_2O$-content of the residue in %, $W_R$=kieserit content of the residue in %.

While the $K_2O$-content $X_A$ of the charge goods is calcuable from formula (IV), the values $X_R$, $W_R$ must be determined by measuring or in the case of $W_A$ by chemical analysis.

In accordance with the invention the following measuring values must be determined.

$M_A$=amount of the charge goods $M_R$=amount of the residue $M_M$=amount of the middling goods $X_R$=$K_2O$-content of the residue $X_{WK}$=$K_2O$-content of the valuable substance concentrate $W_A$=kieserit-content of the charge goods $W_R$=kieserit-content of the residue.

The novel features which are considered as characteristic for this invention will be best understood from the description of specific embodiments when read in connection with the accompanying drawing.

DESCRIPTION OF THE PREFERRED EMBODIMENTS

For measuring the $K_2O$-content during the operation of the process in accordance with the invention, a device has been proved to be suitable which provides, in parallel with the discharge chute for the residue, a level controlled metering container including a metering device for radioactive radiation.

Figure 1:
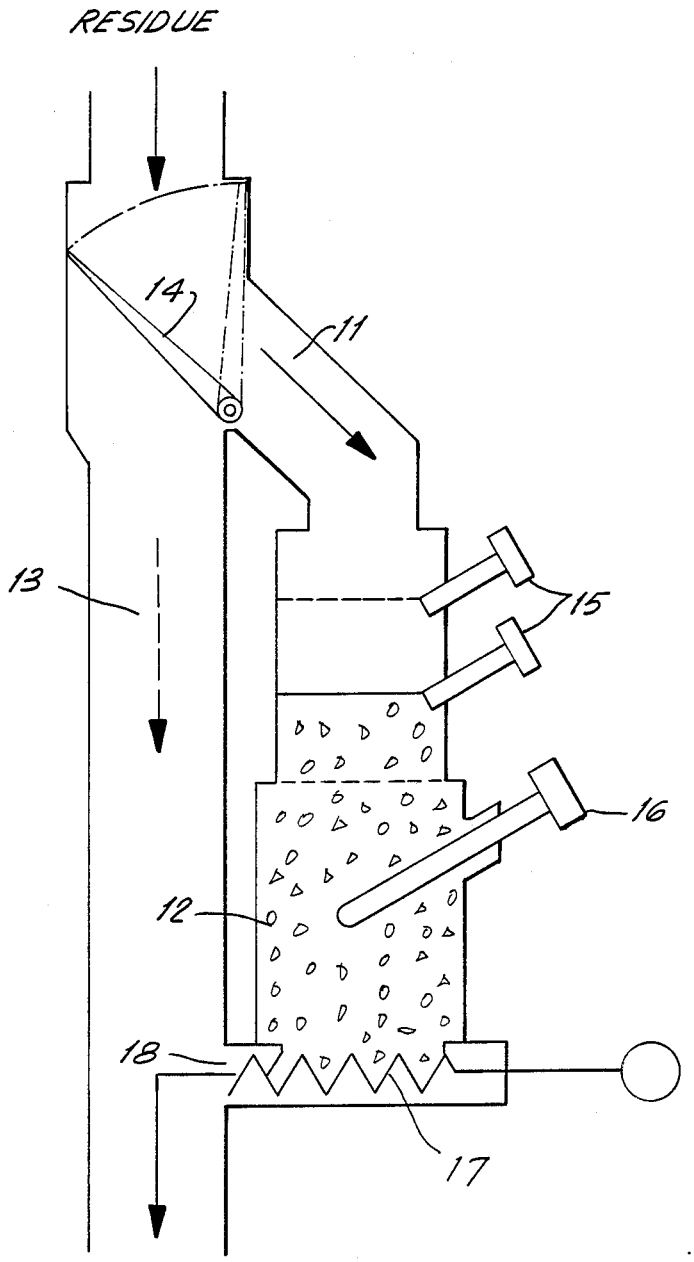
FIGS. 1 and 2 shows schematically different embodiments of devices for measuring $K_2O$ contents in residue.

It is advantageous to use a device which is shown schematically by way of example in FIG. 1. In this device the bypass or branch chute 11 leading to the metering container 12 forms with the discharge chute 13 for the residue as acute angle, when viewed in feeding direction, whereby a pivotable flap 14 provided with a motor drive is mounted on the lower edge of the inlet opening of the branch chute 11. The flap is controlled by means of proximity sensors 15 which are mounted in the metering container 12 above metering device 16. An extruding screw 17 is provided at the bottom of the metering container, whose discharge opening 18 communicates with the discharge chute 13.

In a vertical position of the flap 14 the residue which is introduced from above falls freely through the discharge chute 13 during the electrostatic separation of the crude potash salt. In preparation for metering, the flap 14 is pivoted into the discharge chute, so that the residue is guided into the branch chute 11 and into the metering container 12, until the proximity sensors 15 react and start to control the pivot movement of the flap 14 according to the level of the residue in the metering container 12. The extruder screw 17 provided at the discharge opening 18 of the metering container 12, returns the residue into the discharge chute 13. The device 16 for measuring radioactive radiation of K40-isotope extends into the metering container 12 and its metering results are fed to a non-illustrated computer.

Figure 2:
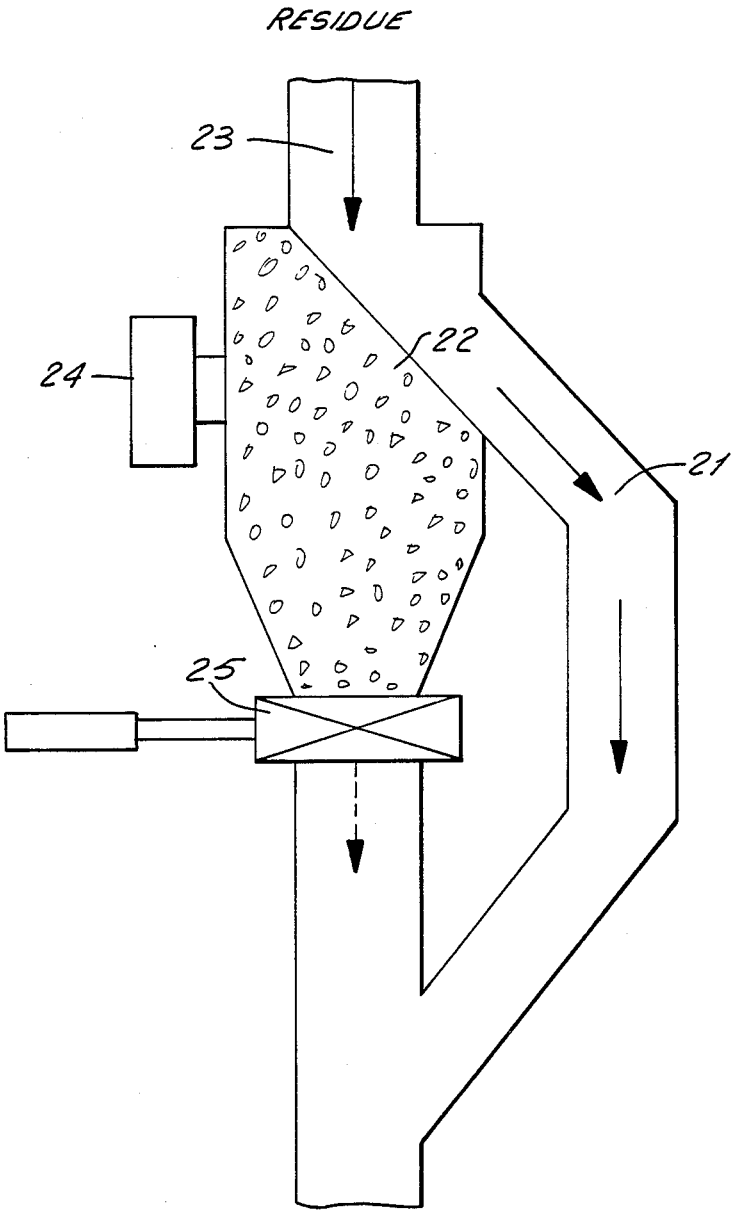

Particularly advantageous is the embodiment of the device for metering the $K_2O$ content in the residue of the electrostatic separation of crude potash salts schematically illustrated in FIG. 2. In this device the cylindrical metering container 22 is provided in the discharge chute 23 for the residue and communicates with overflow bypass conduit 21 which extends laterally along the metering container 22. The metering container 22 is equipped with the device 24 for measuring radioactive radiation of the K40 isotope present in the $K_2O$ component of the residue. The discharge opening in the bottom of the metering container 22 opens into the discharge chute 23 and is closed with a time controlled openable slide 25.

In this device the metering container 22 fills automatically with the residue which flows downwardly through the discharge chute 23 until the overflow line (indicated by a dotted line) is reached. Thereafter, the residue is guided into the overflow bypass conduit 21 branching from metering container 22 to feed the residue into the part of discharge chute 23 below the container. After completion of the metering the time controlled slide 25 is opened and the amount of residue which had been retained in the metering container 22 falls into the lower part of discharge chute. After the metering container is emptied, the slide 25 closes again and the mentioned operations are repeated.

A beta radiation-counting tube is advantageously used as a metering device 16 in the device in accordance with FIG. 1, whereby the metering container 12 must be surrounded by a screen against radioactive radiation. A gamma radiation detector is advantageous as a metering device 24 in accordance with FIG. 2, which is connected with a non-illustrated computer for processing its metering results. The infrared metering is advantageously used for determining the kieserit content $W_R$ of the residue. The infrared metering is based on the absorption of a part of the radiated infrared light by the crystallization water content of the kieserit, which contains the crystallization water as the only constituent. For performing this metering, a partial flow of the residue material to be metered is applied in the form of a layer or band of uniform thickness onto a rotating plate which rotates horizontally around its center axis. An infrared probe is disposed above the rotating plate in such a manner that the infrared ray emitted by the probe impinges upon the band and the probe detects the reflected radiation. The difference between the radiation intensity of the radiated IR-light and the reflected radiation is a measurement for the kieserit content $W_R$ of the residue.

Figure 3:
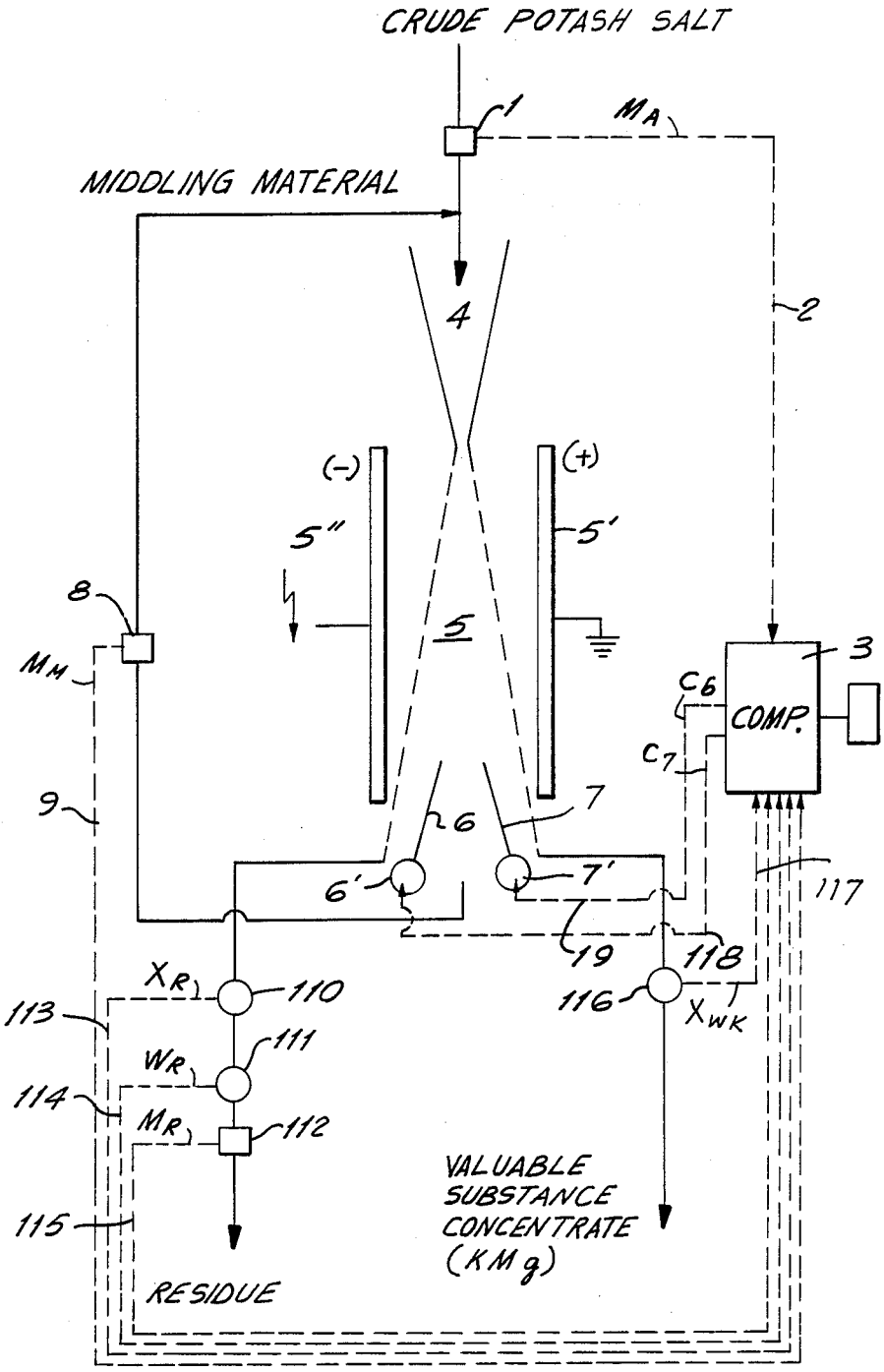
FIG. 3 shows schematically an overall arrangement for performing the process of this invention.

FIG. 3 illustrates schematically an example of an overall arrangement for performing the process of the invention. The charge goods namely the crushed, chemically conditioned and triboelectrically charged crude potash salt, is fed through a device 1 for the quantitative determination, for example, a dosing conveyor weigher, whose metering data $M_A$ are fed by a line 2 to the computer 3. From the device 1, the charged salt flows into the input chute 4 of the electrostatic free fall separator 5. After the raw potash salt had been separated by the effect of the electrostatic field between upright electrodes 5' and 5'' of the separator, the residue is separated by means of the adjustable flow splitting blade 6 and the valuable substance concentrate KMg is separated by means of the adjustable flow splitting blade 7, while the middling material which flows between the blades 6 and 7 is collected and is again admixed to the crude potash salt to be charged, after being crushed again. In this closed cycle of the middling material, a device 8 for quantitative determination is provided, whose metering data $M_M$ are applied via line 9 to the computer 3. Devices 110 and 111 are provided in the discharge chute for the residue which accumulates below the lower end of negative electrode 5'', to determine the $K_2O$-content $X_R$ and the kieserit content $W_R$ therein and a device 112 serves for determining the amount $M_R$ of the residue. The metering data of these devices 110, 111 and 112 are applied via lines 113, 114 or 115 to the computer 3. The device 116 for determining the $K_2O$-content $X_{WK}$ is provided in the discharge chute for the valuable substance concentrate, which accumulates below the lower end of the positive electrode 5'. The valuable substance concentrate consists mostly of potassium chloride and kieserit and is designated as a KMg-concentrate. The metering data $X_{WK}$ of device 116 are applied through line 117 to the computer 3.

The flow splitting blade 6 for the residue is adjusted by pivot drive 6' controlled by output signal C6 from the computer 3. The angle which is encompassed by the blade 6 with the vertical is either increased or decreased during the adjustment. By such a pivot movement of blade 6 the composition and the amount of the residue and therefore, as can be seen from formulas II and III, the discharge of the $K_2O$ and the NaCl components is adjusted. If the angle of the blade 6 is reduced or increased toward the vertical, the $K_2O$ content reduces or increases in the residue, the $K_2O$ discharging is increased or decreased and the NaCl discharge is decreased or increased. The computer 3 compares the discharge values determined by formulas II and III and the metering values $X_R$ with stored nominal or desired values and generates the output signal C6 which controls via line 118 the inclination of the blade 6 according to the desired values.

As already mentioned, the amounts of the charge goods $M_A$, of the middling material $M_M$ and of the residue $M_R$ are detemined by suitable devices like, for example, conveyor weighers 1, 8 and 112. Data corresponding to the amount of returned middling material which is metered at the 8, are fed through line 9 into the computer 3 where they are compared with a predetermined limit range for this return middling material. When the amount of the return middling material exceeds this limit range, the computer 3 emits a control pulse C7 applied through line 19 to the pivot drive 7' for the flow splitting blade 7, so that the latter increases its setting angle relative to the vertical. When the limit range is not reached the setting angle of blade 7 is then decreased accordingly.

A time interval of at least 30 minutes should be allowed between respective changes of inclination of respective blades 6 or 7, since in the separation controlling arrangement the effect of such a change manifests itself only after 20 minutes.

By using the arrangement and controlling process of the invention it is possible to optimize the separating effect of an electrostatic free fall separator for crude potash salts by controlling measuring values through the computer, whereby the manual adjustment of inclination of the separating blades and thus the errors resulting therefrom, is eliminated. Furthermore, the process of the invention offers the possibility to use a plurality of separating stages for the electrostatic separation of crude potash salts in a plurality of series connected electrostatic free fall separators with an optimum separating efficiency and quality.

We claim:

1. Process of the electrostatic separation of crushed, chemically conditioned and triboelectrically changed crude potash salt having $K_2O$ and NaCl constituents, in a free fall electrostatic separator including an upright negative electrode and an upright positive electride for generating the electrostatic field therebetween, and two flow splitting blades pivotably supported below said electrodes and each including a computer controlled drive, said crude potash salt after its passage through the electrostatic field being separated into a valuable substance concentrate accumulating below the lower end of the positive electrode, a residue accumulating below the lower end of the negative electrode, and a middling component whose free fall is substantially unaffected by the electrostatic field, comprising the steps of measuring the amount ($M_A$) of the charged crude potash salt measuring the content ($X_P$) of $K_2O$ and the content ($W_R$) of kieserit in the residue, measuring the the amount ($M_R$) of the residue, measuring the content ($X_{WR}$) of $K_2O$ in the valuable substance concentrate, measuring the amount ($M_M$) of the middling component discharged between said blades, and applying the measured data ($M_A$, $X_R$, $W_R$, $M_R$, $X_{WK}$) to a process computer which computes from the measured data the amount ($M_{WK}$) of the valuable substance concentrate and the content ($W_A$) of kieseret in the charged crude potash salt, and generates output signals for automatically controlling via said drives the angular position of said flow splitting blades as a function of the measured and computed data so as to obtain a desired separating effect.

2. Process in accordance with claim 1, wherein the $K_2O$-content of the residue and of the valuable substance concentrate is determined by the weak radioactive K40 isotope.

3. Process in accordance with claim 1, wherein the separating effect is determined in accordance with the formula $$rK_2O = \frac{M_{WK} \cdot X_{WK}}{M_A - X_A} \cdot 100$$

$$\text{with } X_A = \frac{M_R \cdot X_R + M_{WK} \cdot X_{WK}}{M_A}$$

$$\text{and } M_{WK} = M_A - M_R$$

wherein r $K_2O$=the separating effect with reference to the discharge of the $K_2O$, $M_A$=amount of crude potash salt, $M_{WK}$=amount of valuable substance concentrate, $M_R$=amount of residue $X_A$=$K_2O$-content of the crude potash salt, $X_R$=$K_2O$-content of the residue and $X_{WK}$=$K_2O$-content of the valuable substrate concentrate, and are calculated from the metering values $M_A$, $M_R$, $X_R$ and $X_{WK}$.

4. Process in accordance with claim 1, wherein the desired separating effect is determined by the formula $$rNaCl = \frac{M_R \cdot Y_R}{M_A - Y_A} \cdot 100$$

$$\text{with } Y_R = -1.35\, Z_1 + 98.8$$

$$\text{and } Z_1 = \frac{X_R}{0.632} + W_R$$

$$\text{and } Y_A = -1.03 Z_2 + 92.06$$

$$\text{and } Z_2 = \frac{X_A}{0.632} + W_A$$

wherein r NaCl=the separating effect with reference to the NaCl discharge, $M_R$=residue amount, $M_A$=amount of the crude potash salt, $Y_R$=NaCl-content of the residue, $X_R$=$K_2O$-content of the residue, $W_R$=kieserite-content of the residue, $Y_A$=NaCl-content of the crude potash salt, $X_A$=$K_2O$-content of the crude potash salt and $W_A$=kieserite-content of the crude potash salt and is approximately calculated from the metering values $M_A$, $M_R$, $X_R$, $W_R$, and $W_A$.

5. Process in accordance with claim 4, wherein the kieserit-content of the residue is continuously measured by infrared reflection, while the kieserite-content of the crude potash salt is determined by chemical analysis in predetermined time intervals.

6. Process as defined in claim 1, wherein the middling component is added to the crude potash salt to be separated, and reintroduced therewith into the electrostatic separator.

7. Process in accordance with claim 1 wherein said residue and said valuable substance concentrate are discharged, respectively, into a fall chute provided with a bypass chute which includes a metering container and a device for measuring the content of $K_2O$.

* * * * *